US007634843B1

(12) United States Patent
Michnuk

(10) Patent No.: US 7,634,843 B1
(45) Date of Patent: Dec. 22, 2009

(54) MEMORIAL URN

(76) Inventor: Paul S. Michnuk, 115 Bondsville Rd., Downingtown, PA (US) 19335

( * ) Notice: Subject to any disclaimer, the term of this patent is extended or adjusted under 35 U.S.C. 154(b) by 0 days.

(21) Appl. No.: 12/130,144

(22) Filed: May 30, 2008

(51) Int. Cl.
*A61G 17/00* (2006.01)

(52) U.S. Cl. ..... 27/1

(58) Field of Classification Search ..... 27/1, 27/35; D99/5; 52/134, 136, 103; 40/124.5; 220/327, 328, 378
See application file for complete search history.

(56) References Cited

U.S. PATENT DOCUMENTS

| | | | | |
|---|---|---|---|---|
| 5,029,373 | A * | 7/1991 | Raymond | 27/1 |
| 5,230,127 | A | 7/1993 | Zukowski et al. | |
| 5,287,603 | A * | 2/1994 | Schorman | 27/1 |
| 5,349,727 | A | 9/1994 | Niebergall | |
| D353,994 | S | 1/1995 | Kohler | |
| 5,740,637 | A * | 4/1998 | Snow | 52/136 |
| 6,076,292 | A | 6/2000 | Kawa | |
| 6,167,600 | B1 * | 1/2001 | Williams et al. | 27/1 |
| D438,362 | S | 2/2001 | Robinson | |
| D440,735 | S | 4/2001 | Robinson | |
| D444,288 | S | 6/2001 | Robinson | |
| 6,295,705 | B1 | 10/2001 | Gersten | |
| 6,584,658 | B2 | 7/2003 | Robinson | |
| D493,934 | S | 8/2004 | Diviak, Sr. | |
| D494,727 | S | 8/2004 | Poteet | |
| 6,988,299 | B1 * | 1/2006 | Barrette et al. | 27/1 |
| 7,191,499 | B2 * | 3/2007 | Davis et al. | 27/1 |
| 7,287,306 | B1 * | 10/2007 | Green | 27/1 |
| 2001/0047575 | A1 | 12/2001 | Bernhardt | |
| 2004/0040129 | A1 | 3/2004 | Ogle, II | |
| 2005/0125973 | A1 * | 6/2005 | Hankel et al. | 27/1 |
| 2005/0246877 | A1 | 11/2005 | Davis et al. | |

FOREIGN PATENT DOCUMENTS

| | | |
|---|---|---|
| JP | 8266578 | 10/1996 |
| JP | 200412462 | 2/2001 |
| JP | 2002224178 | 8/2002 |

OTHER PUBLICATIONS

"Pet Memorials," Specialty Pet Producst.com. http://www.specialtypetproducts.com/Merchant2/merchant.mv?Screen=CTGY&Store_Code=MDT&Category_Code=urns, 2 pages printed from the internet Feb. 8, 2006.

"Custom Photo Pet Urns," EncompassTech.com. http://www.encompasstech.com/peturns.htm, 3 pages, printed from the internet Feb. 16, 2006.

"Pet Urns," AllAboutPetUrns.com. http://www.allaboutpeturns.com, 4 pages, printed from the internet Feb. 8, 2006.

* cited by examiner

*Primary Examiner*—William L. Miller
(74) *Attorney, Agent, or Firm*—Volpe and Koenig, P.C.

(57) ABSTRACT

A memorial container for storage of crematory remains is disclosed. A body having an opening and a panel attachable to the opening by fasteners and mounting blocks is provided. A gasket material is affixed to the perimeter of the opening or the panel to create a seal upon closure. Supports are provided to permit the container to be displayed on a variety of irregular or unlevel surfaces. Designs and memorabilia may be displayed on various outer surfaces of the container and may be created by a variety of methods, including engraving.

18 Claims, 6 Drawing Sheets

FIG. 8
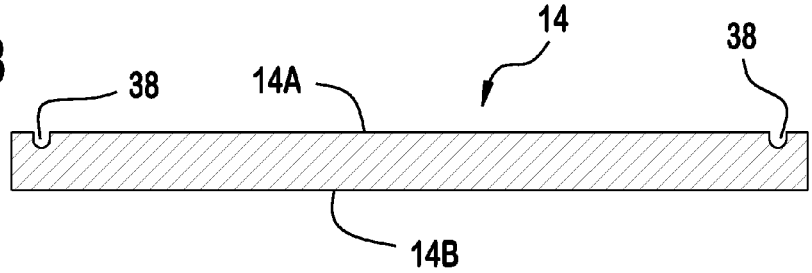
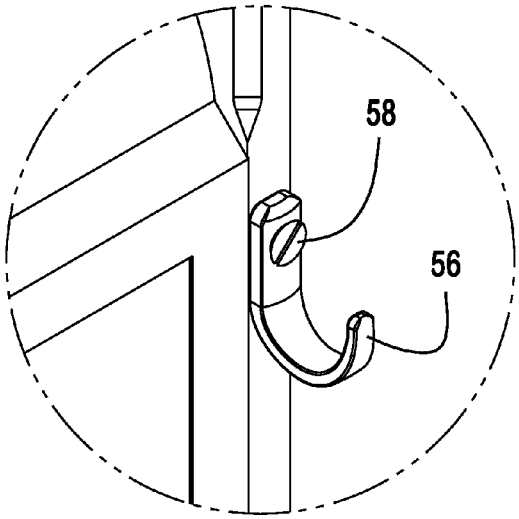
FIG. 10
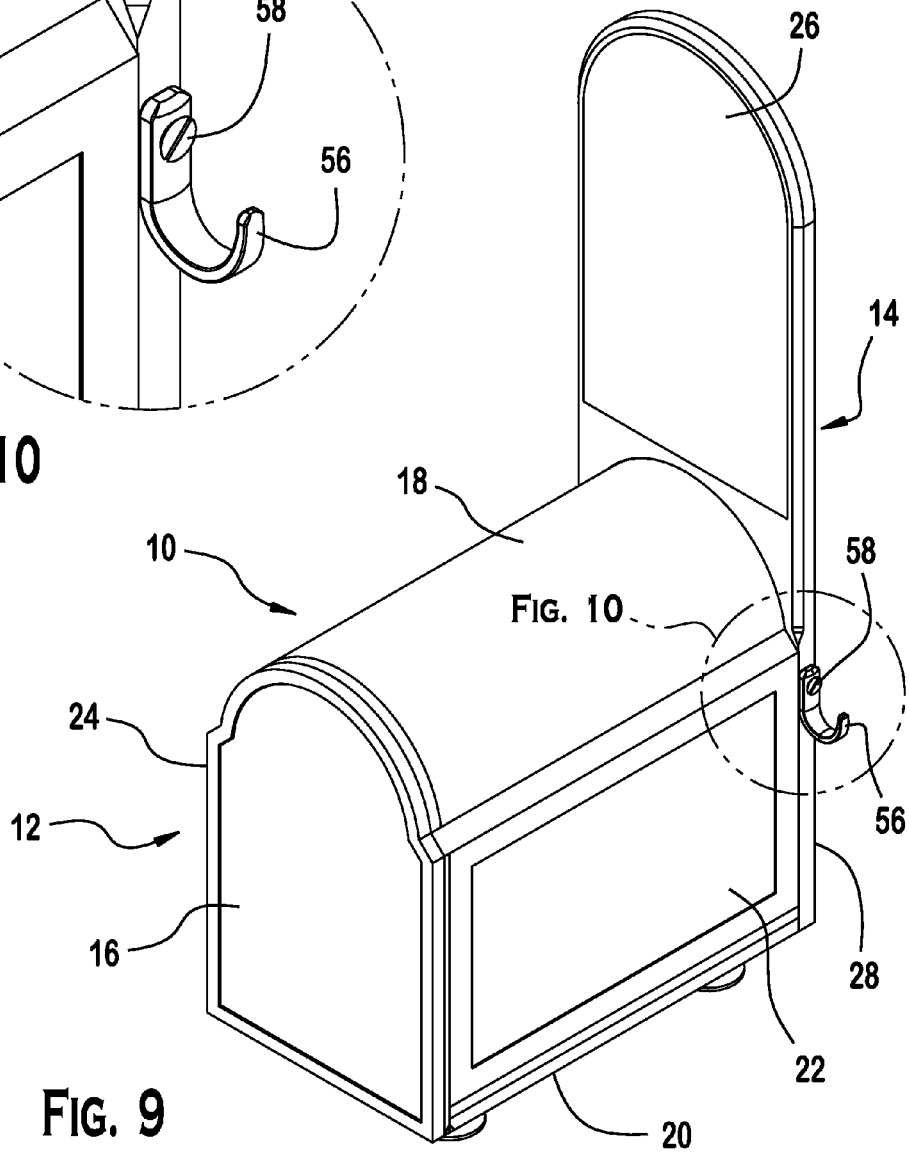
FIG. 9

MEMORIAL URN

FIELD OF THE INVENTION

The present invention relates to a receptacle for storing crematory remains and commemorating the deceased. Specifically, the present invention relates to a sealable container with adjustable supports that permit it to be displayed on a variety of surfaces and structures.

BACKGROUND

Cremation of the mortal remains of living creatures, such as humans and pets, is a long established practice. During the cremation process, the mortal remains are reduced to ash. Relatives and loved ones often desire to retain the ashes in memory of the deceased. The ashes are generally stored in an urn, a container often resembling a vase. It may be desirable to display the container inside the home or as part of an outdoor memorial.

It is desirable for the container to be sealable to prevent loss of ashes and the entry of foreign materials such as water. It is also desirable for a container to have adjustable supports, for positioning the container on various surfaces and topographies. In many cases, it is also desirable for a memorial container to incorporate decorative features such as by displaying a plaque identifying or commemorating the deceased. While the prior art has separately addressed the use of sealing means, supports and decorative features, it has not addressed each of these problems together while providing the desired adjustable supports.

SUMMARY

The memorial container includes a body having an interior chamber. A panel, preferably having a gasket affixed about the perimeter of one side, is used to close and seal the chamber after crematory remains are placed inside. The panel is attached over the opening using fasteners that connect with mounting blocks affixed to the body.

The container includes supports. In one embodiment, the supports are leveling members for adjusting the distance between the container and a resting surface. In another embodiment, the container includes rods for attaching the urn to a mounting surface.

The present invention solves the problems of the prior art by providing a memorial container for storage of crematory remains of humans and pets which is completely sealed and permits display on a wide variety of surfaces.

BRIEF DESCRIPTION OF THE DRAWINGS

The following detailed description of the preferred embodiments of the invention will be better understood when read in conjunction with the appended drawings.

FIG. 8 is a section along the line 8-8 in FIG. 4.

FIG. 9 is an isometric view of a container having a memorial hook in another embodiment of the present invention.

FIG. 10 is an enlarged perspective view of the memorial hook of the embodiment of FIG. 9.

DETAILED DESCRIPTION OF THE PREFERRED EMBODIMENTS

Figures 1, 2:
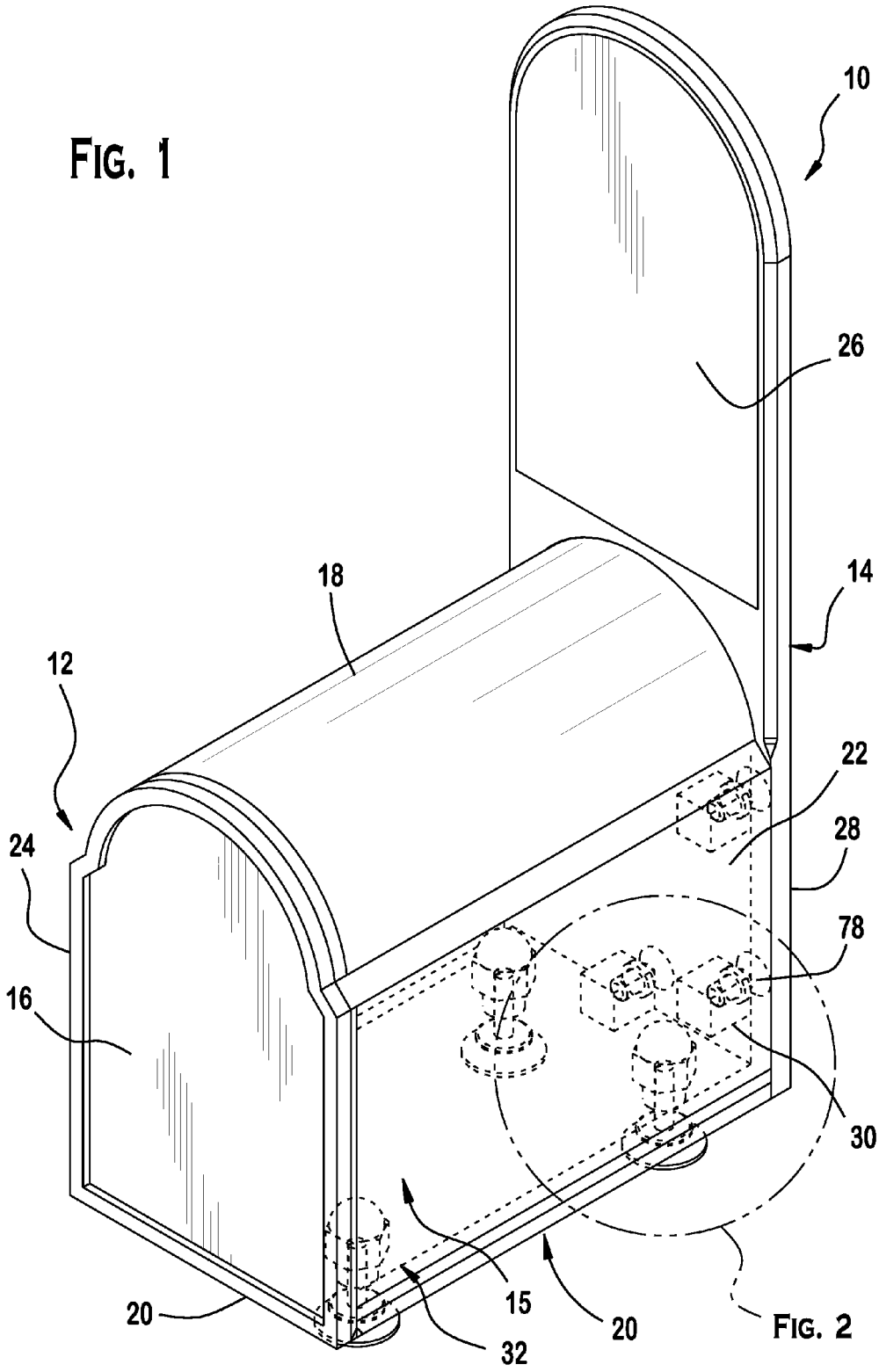
FIG. 1 is a front isometric view of a container with a side removed to show the supports and mounting blocks in one embodiment of the present invention.
FIG. 2 is an enlarged view of the detail in FIG. 1 showing the supports and interior mounting block connections.
Figure 2:
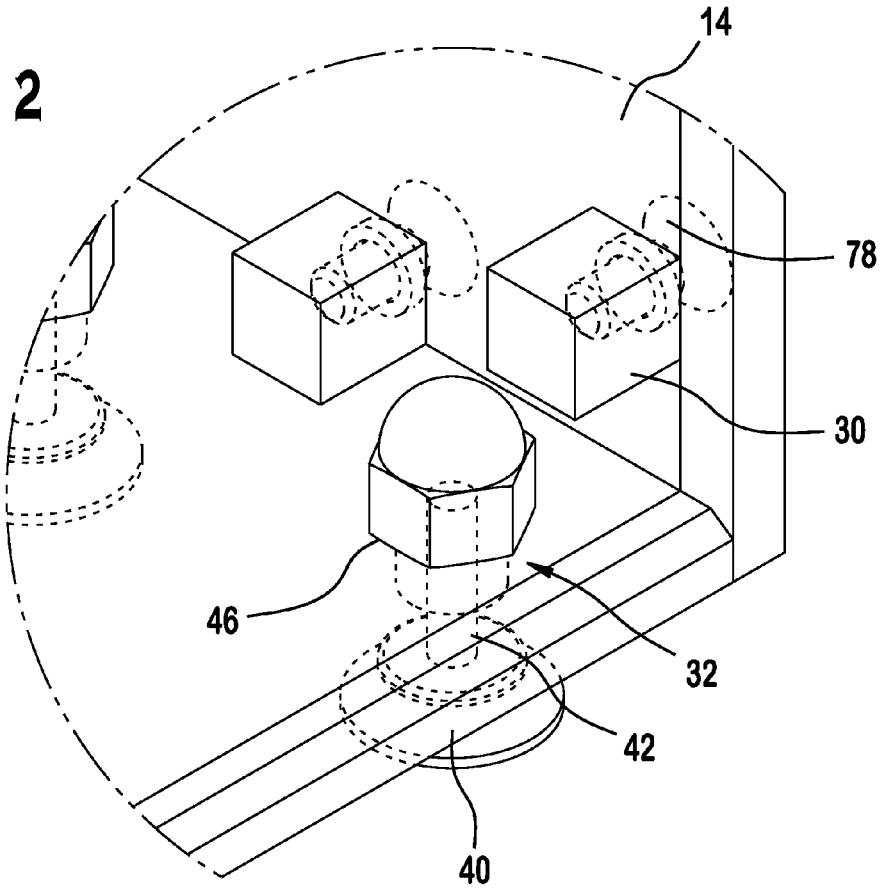

With reference to FIG. 1, the memorial container 10 provides a chambered body 12 for storing cremated remains. The chambered body 12 is defined by a base 20, front wall 16, a lower portion 28 of rear panel 14 and first and second side walls 22, 24. Each of the walls 16, 22, 24 and portion 28 extends upwards from the base 20 and joins with a top or roof 18 in a sealed relationship. In this embodiment, the container 10 has the general "n" shape. If desired, the walls 22 and 24 and top 18 may be formed as one piece such as by stamping metal or molding plastic. The front wall 16 is shaped to mate with the front edge of the arcuate roof 18. Each of the base 20, front wall 16, roof 18 and side walls 22, 24 has an interior side and an exterior side. The body components are preferably joined together to form a permanent and impermeable seal, such as by metal welding or heat welding for thermoplastic materials. Prior to use, the chambered body 12 has an interior chamber 15 with an opening 25, see FIG. 4, for receiving cremated remains. The opening 25 is closed by lower sealing portion 28 of panel 14 having an interior side 14A and an exterior side 14B (See FIG. 8).

Figure 4:
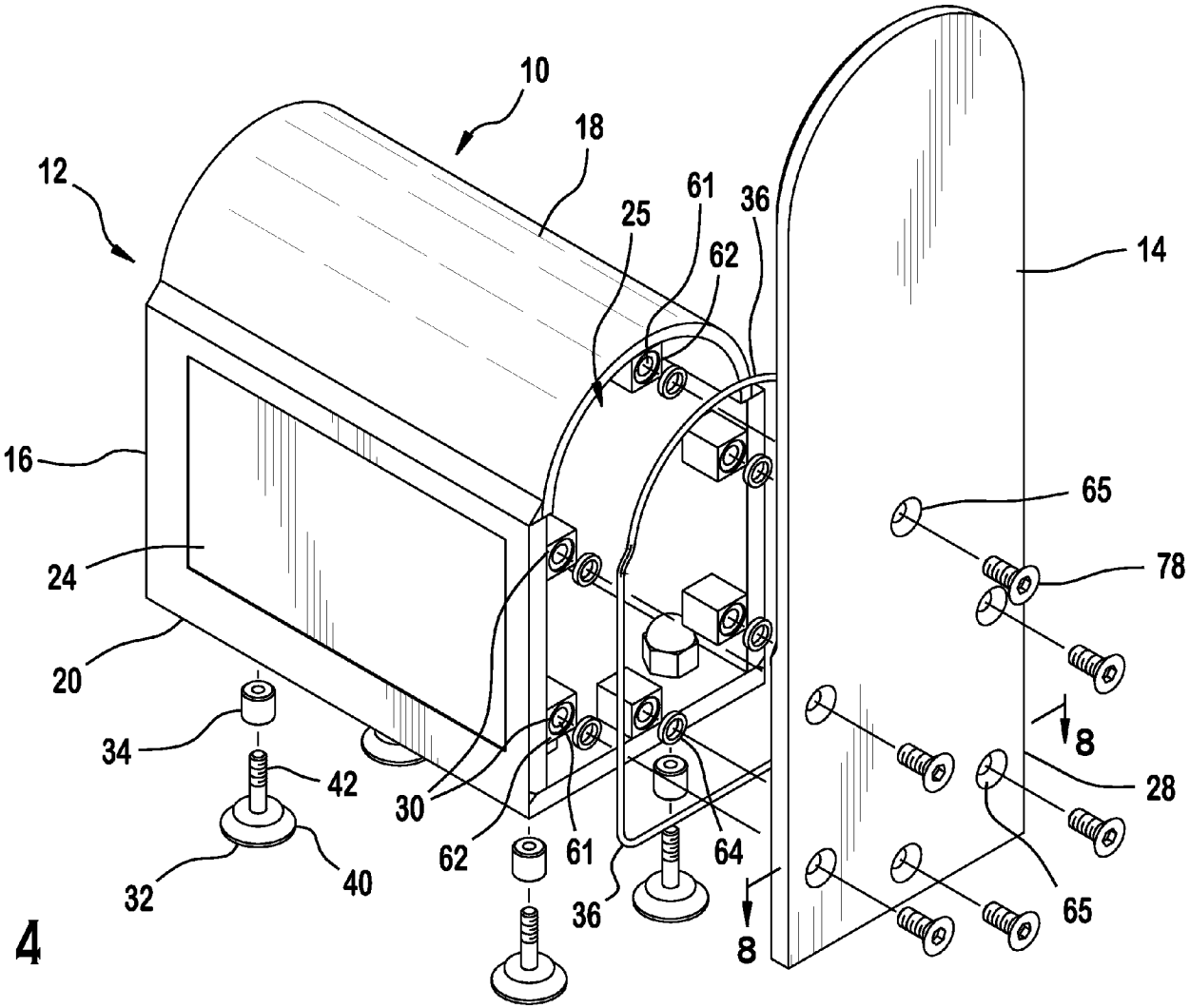
FIG. 4 is an exploded isometric view of the container having supports, fasteners for connecting with mounting blocks and a gasket for sealing the panel over the opening in another embodiment of the present invention.

In the embodiments shown in FIGS. 1, 4, 5 and 9, the panel 14 is divided into an upper presenting portion 26 and the lower sealing portion 28. As shown in FIG. 4, the lower sealing portion 28 is secured by fasteners 78 for sealing over the opening 25. The upper presenting portion 26 may provide a commemorating surface to identify or honor the deceased.

As shown in the preferred embodiment in FIGS. 4 and 8, the lower portion 28 is grooved to receive a gasket 36 for sealing the panel 14 over the opening 25. The gasket 36 may be affixed to the outer edges of the defined opening 25, or about the perimeter of the interior side of the panel 14. With reference to FIG. 8, the perimeter of the interior side 14A of the panel 14 defines a groove 38 for receiving the gasket material 36, such as an O-ring. The depth of the groove 38 is less than the diameter of the gasket 36 so that when the panel 14 is fixed over the opening 25, the gasket 36 is compressed between the interior of the groove 38 and the panel 14, to create a seal. Alternatively, the gasket 36 may be affixed about the perimeter of the interior side of the panel 14 and a groove defined along the edges of the defined opening 25.

As shown in FIGS. 1, 2, 4, 5 and 6, mounting blocks 30 are attached to the interior of the body 12, in proximity to the opening 25 and aligned with apertures 65 in the panel 14 (see FIG. 4), to facilitate securing of the panel 14 over the opening 25. Preferably, a plurality of mounting blocks 30 are attached to the interior of the body 12 so the panel 14 is drawn flush and the seal is maintained through a variety of environmental conditions. In this preferred embodiment of stainless steel, six of the blocks 30 are provided.

As noted previously, the panel 14 is preferably attached over the opening 25 by a plurality of fasteners 78 coupling with the mounting blocks 30. In the preferred embodiment shown in FIG. 4, each mounting block 30 comprises a cube having a threaded recess 61 surrounded by a circular groove 62, on the face of the mounting block 30 nearest to the opening 25, that provides a seat for a gasket, preferably an O-ring 64. The holes 65 in panel 14 are aligned with a respective mounting block recess 61. The fasteners 78 are preferably countersunk Allen head screws 78 that extend through the panel holes 65 and thread into the mounting blocks 30 so they are flush with the surface the exterior side of the panel 14B. Alternatively, slotted or Phillips head screws may be used as fasteners 78. The fasteners 78 may include security devices to prevent removal after installation (not shown). With the tightening of the screws 78, the gaskets 64 are compressed within the grooves 62, a seal is created and the contents are protected from the surrounding environment.

In the preferred embodiment shown in FIGS. 9 and 10, the container further comprises a memorial hook 56 for presentation of memorabilia such as identification tags belonging to the deceased. The memorial hook 56 is preferably attached to an outer edge of the panel 14, but may be attached to a section of the body 12. In the embodiment shown in FIGS. 9 and 10, the hook 56 is attached by a screw 58, but other types of fastening, such as spot welding and adhesives, may be used as well.

Figure 3:
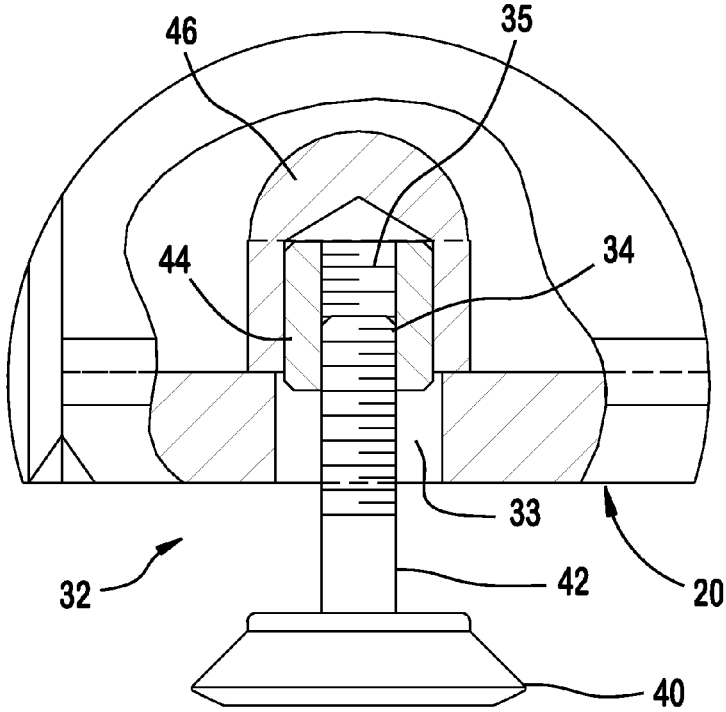
FIG. 3 is a sectional view of a support of the embodiment of FIG. 1.

The base 20 may contain any one of a variety of supports, depending on the desired location for the container 10. FIGS. 1, 2 and 3 illustrate one preferred embodiment in which the container 10 has adjustable leveling members 32. As best shown in FIG. 3, each of the four leveling members 32 has a support receiving member 46 that is affixed to the base 20 over an aperture 33 in a permanently sealed connection, such as by welding, and support member comprising an exterior connector rod 42 that connects to a foot 40 and extends through the aperture 33 in base 20. The connector rod 42 includes a threaded portion 34. The connector rod 42 connects to the foot 40 so that adjustment of the rod 42 positions the memorial container 10 at rest on the surface beneath the memorial container 10.

In the preferred embodiment shown in FIGS. 1, 2 and 3, intermediate support members 44 for mating with the support receiving members 46 are further provided. As illustrated, the support receiving members 46 are cap nuts with standard interior threads. As can be seen clearly in FIG. 3, the connector rod 42 does not fill the aperture 33. This is because the illustrated embodiment reflects an application where the memorial container 10 is in an interior location and less robust leveling members 32 are desired. To accommodate this application, an intermediate support member which is a set screw 44 is placed in the threads of the support receiving members 46 so that a slimmer connector rod 42 may be used. The set screws 44 are preferably socket head set screws, but may be slotted or Phillips head screws. Each set screw 44 is bored to have an interior threaded cavity 35 for receiving the connector rod 42 of the leveling members 32. The threaded bore is selected so that set screw 44 can still be inserted and removed from the supporting member 46 so the memorial container 10 can be used with more robust connector rod 42 or mounted more permanently to a surface, see FIGS. 6 and 7. As shown in FIG. 3, the intermediate support member 44 preferably extends below the top surface of the interior side of the base 20. In an alternative embodiment to that shown in FIG. 3, the set screw may extend even further below the top surface of the base to provide greater stability to the leveling member 32.

Figures 5, 6:
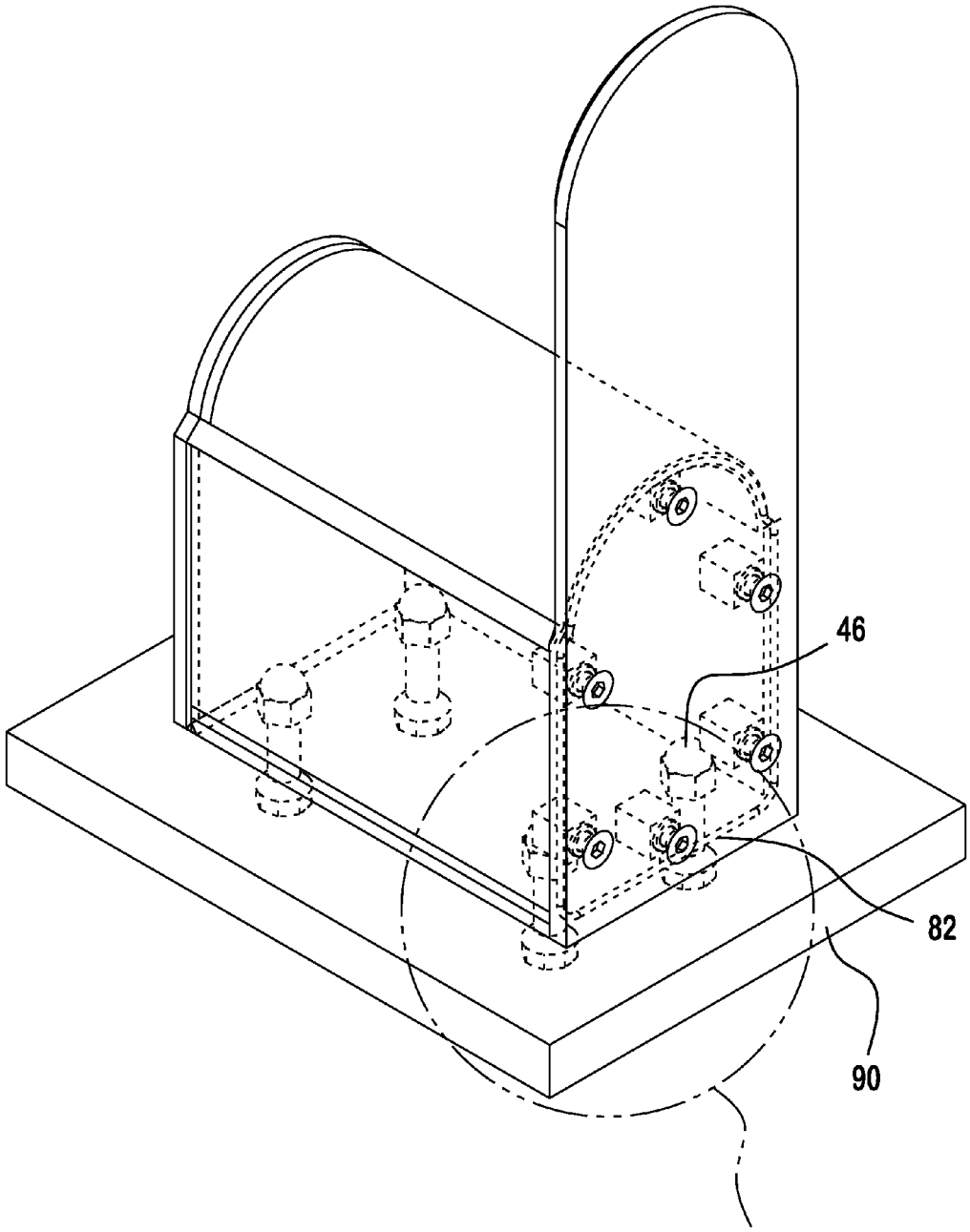
FIG. 5 is a rear isometric view of a mounted container with the base, rear and a side removed to show mounting bolts in another embodiment of the present invention.
FIG. 6 is an enlarged view of the detail in FIG. 5 showing the bolts and interior mounting block connections.
Figure 6:
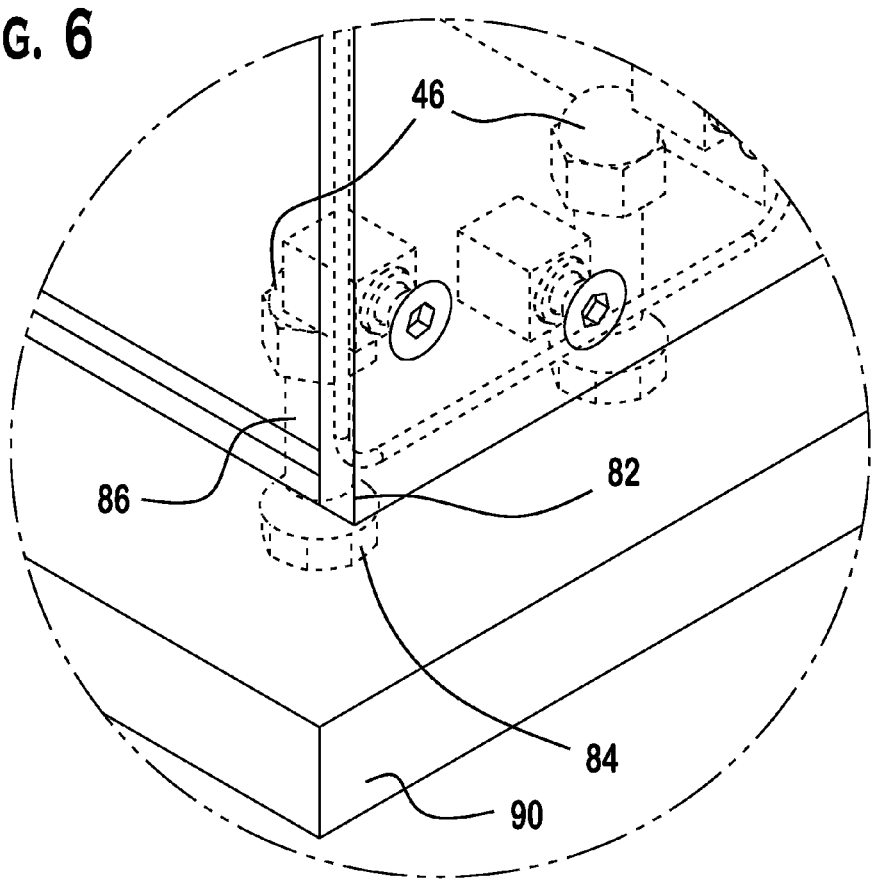
Figure 7:
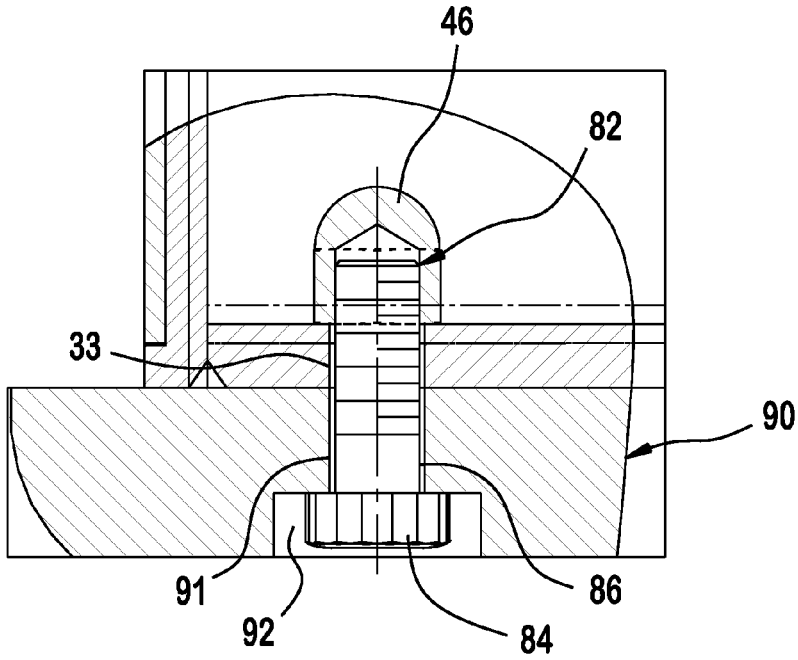
FIG. 7 is a sectional view of the bolted connection to a mounting surface of the embodiment of FIG. 5.

In the embodiment shown in FIGS. 5-7, the supports comprise rods 82 for fixing the body 12 to a surface 90. As is best shown in FIG. 7, the rods 82 are preferably bolts having a head 84 and a shaft 86. In this embodiment, the base 20 defines apertures 33. A structure 90 to which the memorial container 10 is to be mounted has holes 91 of matching size and corresponding location. Bolts 82 are inserted through holes 91 of the structure 90 and the holes 33 of the base 20 of the memorial container 10, such that the bolt heads 84 abut the bottom surface of the mounting structure 90. In the embodiment of FIG. 7, the bottom surface of the structure 90 defines a recess 92, for receiving a bolt head 84, to prevent the bolt head from protruding from the bottom surface of the mounting structure 90. A threaded end of each bolt shaft 86 protrudes through the interior surface of the base 20 and mates with a respective supporting member 46.

The memorial container 10 is preferably made of stainless steel, but can be made of various other water impermeable materials, including metals and plastics.

Various surfaces of the memorial container 10 such as the front wall 16, side walls 22, 24 and upper portion 26 of the panel 14 can be used to display words or images commemorating the deceased. Such displays are preferably created by engraving, but may be created by other means as well. In the embodiment shown in FIGS. 1 and 9, the interior side 14A of the upper portion 26 of the panel includes a commemorating surface. A commemorating surface may also be provided on the exterior side 14B of the panel, or on another surface of the body 12, such as one or more of the walls 16, 22, 24.

In each of the embodiments shown in the drawing figures, the body 12 is shaped to resemble a coffin, and the panel 14 is shaped to resemble a headstone. While this illustrates one preferred embodiment, the present invention should not be regarded as limited to taking on such an appearance.

What is claimed is:

1. A cremated remains memorial container comprising:

a sealed body chamber for storing cremated remains therein that has a plurality of sealed apertures defined in a selected portion of the body chamber and an opening for receiving the cremated remains therethrough;

a panel that closes and seals the opening;

a plurality of support receiving members that seal the plurality of apertures, each support receiving member having an internally threaded portion disposed towards one of the apertures; and a plurality of intermediate support members, each having a threaded exterior that mates with the internally threaded portion of a respective support receiving member and a threaded interior portion;

a plurality of supports, each of the supports having a threaded first end that mates with the threaded interior portion of a respective intermediate support member.

2. The memorial container of claim 1, wherein the supports are equal in number to the plurality of support receiving members.

3. The memorial container of claim 1, each of the plurality of supports includes a foot connected to a second end of the respective support.

4. The memorial container of claim 1, further comprising a memorial hook attached to a portion of the body chamber.

5. The memorial container of claim 1, wherein the body chamber is defined by a base, a front wall, first and second side walls and a roof.

6. The memorial container of claim 5, wherein the base, front wall, first and second side walls and the roof are welded together.

7. The memorial container of claim 1, further comprising a gasket attached to at least one of the panel or the body chamber about the opening, such that the gasket seals the container when the panel is attached over the opening.

8. The memorial container of claim 7, wherein:

the gasket is attached to the body chamber about the location of the opening;

the panel comprises an interior side and an exterior side; and a groove is defined about the perimeter of the panel on the interior side for receiving a portion of the gasket when the panel is attached over the opening.

9. The memorial container of claim 1, wherein the panel comprises:

an upper presenting portion comprising a surface that may be used to identify or honor the deceased; and a lower sealing portion that seals the opening.

10. The memorial container of claim 1, wherein the body chamber includes at least one surface for engraving.

11. The memorial container of claim 1, wherein the plurality of apertures, support receiving members, intermediate support members, and supports are all equal in number.

12. A cremated remains memorial container comprising:

a sealed body chamber for storing cremated remains therein that has a plurality of sealed apertures defined in a selected portion of the body chamber, and defines an opening for receiving the cremated remains therethrough;

a plurality of support receiving members that seal the plurality of apertures;

a plurality of supports that pass through a respective aperture and connect with a respective support receiving member;

a panel that closes and seals the opening; and mounting blocks and fasteners, wherein the panel is attached over the opening by connections formed between the mounting blocks and the fasteners.

13. The memorial container of claim 12, wherein:

the mounting blocks are attached to the body chamber at locations proximate to the opening;

the panel defines holes, each hole corresponding to a mounting block and located such that it may be aligned with the mounting block when the panel is placed over the opening; and the fasteners are insertable though the holes of the panel and attach to the mounting blocks.

14. The memorial container of claim 12, further comprising a memorial hook attached to a portion of the body chamber.

15. A method of closing and sealing a cremated remains memorial container comprising:

providing the creamed remains memorial container comprising:

a sealed body chamber for storing cremated remains that has a plurality of sealed apertures defined in a selected portion of the body chamber and defines an opening for receiving the cremated remains therethrough;

a panel that closes and seals the opening;

a gasket attached to at least one of the panel or the body chamber about the opening;

mounting blocks attached to the body chamber at locations proximate to the opening;

holes defined in the panel, each hole corresponding to a mounting block and located in alignment with the mounting block when the panel is placed over the opening;

fasteners that are insertable through the holes of the panel and attachable to the mounting blocks;

placing the panel over the opening in a position such that the holes of the panel align with the mounting blocks; and inserting a fastener through each hole defined in the panel and affixing the fastener to the corresponding mounting block.

16. The method of claim 15, further comprising a step of providing a memorial hook attached to a portion of the body chamber.

17. A method of leveling a cremated remains memorial container comprising:

providing the cremated remains memorial container comprising:

a body chamber for storing cremated remains that has a plurality of apertures defined in a selected portion of the body chamber and an opening for receiving the cremated remains therethrough;

a panel that closes and seals the opening:

a plurality of support receiving members that close the apertures, each support receiving member having an internally threaded portion disposed towards one of the apertures;

a plurality of intermediate support members, each having a threaded exterior that mates with the internally threaded portion of a respective support receiving member and a threaded interior portion;

a plurality of supports, each support having a threaded first end, a second end, and a foot connected to the second end; and threading the threaded first end within the threaded interior portion of a respective intermediate support member.

18. The method of claim 17, further comprising a step of providing a memorial hook attached to a portion of the body chamber.

* * * * *